US007901544B2

(12) United States Patent
Aldrich

(10) Patent No.: US 7,901,544 B2
(45) Date of Patent: Mar. 8, 2011

(54) PAPER MACHINE FABRIC LEADER

(75) Inventor: William Daniel Aldrich, Wilson, NC (US)

(73) Assignee: Voith Paper GmbH, Heidenheim (DE)

( * ) Notice: Subject to any disclaimer, the term of this patent is extended or adjusted under 35 U.S.C. 154(b) by 613 days.

(21) Appl. No.: 11/654,299

(22) Filed: Jan. 17, 2007

(65) Prior Publication Data

US 2007/0167100 A1 Jul. 19, 2007

Related U.S. Application Data

(60) Provisional application No. 60/759,648, filed on Jan. 17, 2006.

(51) Int. Cl.
*D21F 1/32* (2006.01)

(52) U.S. Cl. ..... 162/200; 162/273; 162/274; 428/99

(58) Field of Classification Search ..... 152/273, 152/274, 200; 226/92; 428/99; 34/120
See application file for complete search history.

(56) References Cited

U.S. PATENT DOCUMENTS 6,398,915 B1 6/2002 Fargeout
6,447,873 B1 9/2002 Kornett

FOREIGN PATENT DOCUMENTS

EP 1676952 A1 7/2006

*Primary Examiner* — Mark Halpern
(74) *Attorney, Agent, or Firm* — Bachman & LaPointe, P.C.

(57) ABSTRACT

A paper machine fabric leader includes a leader having a first end, a second end, a first leader face and a second leader face, the first end being connected to a paper machine fabric; and a solid sheet cover attached to the first leader face of the leader. A method for making the paper machine fabric leader is also disclosed.

21 Claims, 2 Drawing Sheets

PAPER MACHINE FABRIC LEADER

CROSS REFERENCE TO PROVISIONAL APPLICATION

This application claims the benefit of the filing date of commonly owned provisional patent application Ser. No. 60/759,648 filed Jan. 17, 2006.

BACKGROUND OF THE INVENTION

The invention relates to paper machine fabrics and, more particularly, to a leader for installing machine fabric on a paper machine.

Paper machine fabric leaders are used to install paper machine fabric on a paper machine. It is known to pull fabrics onto the machine using ropes or straps. However, ropes and straps get caught in various elements of the paper machine. To avoid this problem, triangular leader formations were developed. However, this type of leader resulted in non-uniform tension, and reinforcements to the triangular leader were then developed, for example as taught in U.S. Pat. Nos. 6,398,915 and 6,447,873. Unfortunately, these reinforcements lead to increased cost.

Based upon the state of the art, it is clear that the need exists for a paper machine fabric leader which addresses these issues.

SUMMARY OF THE INVENTION

It is therefore the primary object of this invention to provide a paper machine fabric leader which has less tendency to get caught in the paper machine, and which can be manufactured at an economical cost.

Other objects and advantages of the invention will appear herein.

According to the invention, these objectives have been attained.

According to the present disclosure, a paper machine fabric leader is provided which comprises a leader having a first end, a second end, a first leader face and a second leader face, the first end being connected to a paper machine fabric; and a solid sheet cover attached to the first leader face of the leader.

A method is also provided for making a paper machine fabric leader, and comprises attaching a solid sheet cover to a leader at a first leader face.

The leader is in one embodiment a plurality of straps which are connected at one end to the paper machine fabric and which are joined at the other end to define a connection point for a pull rope or the like.

The solid sheet cover can in one embodiment be substantially transparent whereby the position and quality of the straps can be observed.

In another aspect of the invention, the solid sheet cover can be substantially impermeable to water or other liquids to which the paper machine fabric might be exposed prior to installation, and the solid sheet cover thereby serves to protect the paper machine fabric from such liquids during shipping and storage prior to use.

Additional details of the present invention are discussed in the following detailed description.

BRIEF DESCRIPTION OF THE DRAWINGS

A detailed description of preferred embodiments of the present invention follows, with reference to the attached drawings, wherein.

DETAILED DESCRIPTION

Figure 1:
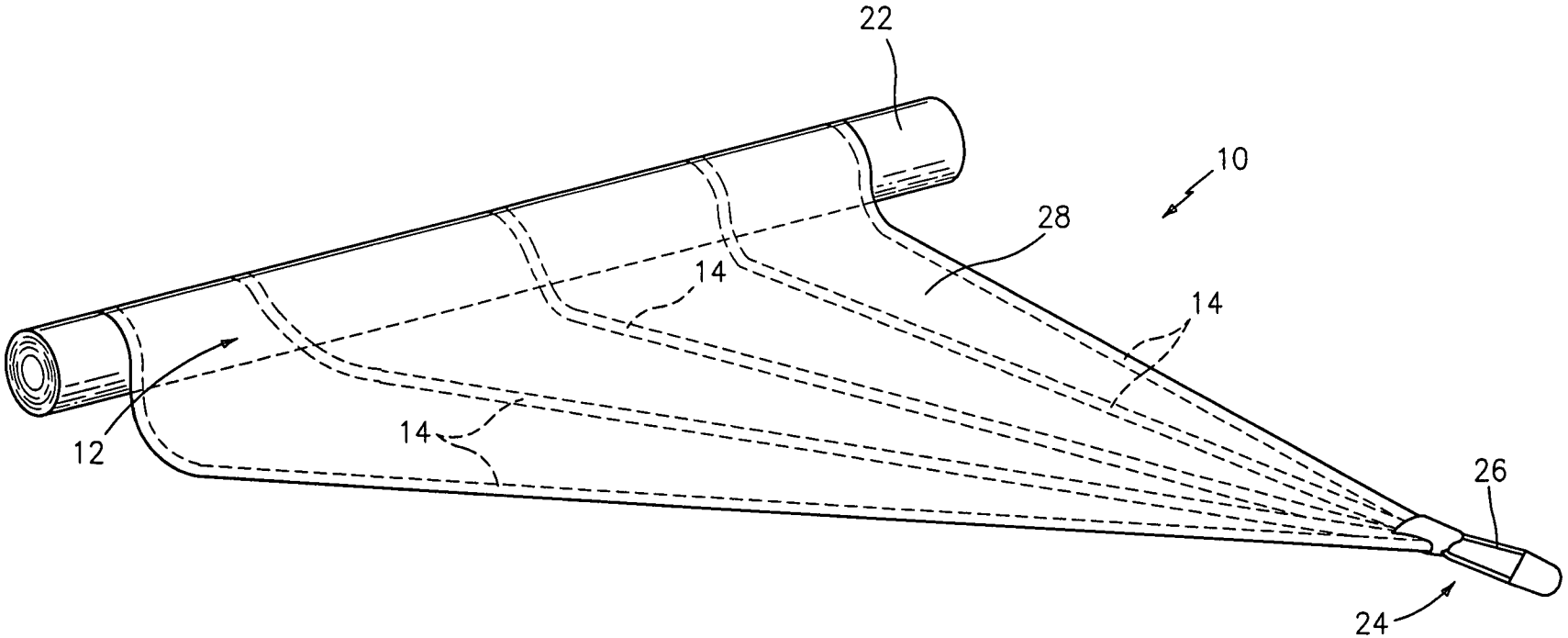
FIG. 1 shows a paper machine fabric leader according to the invention.
Figure 2:
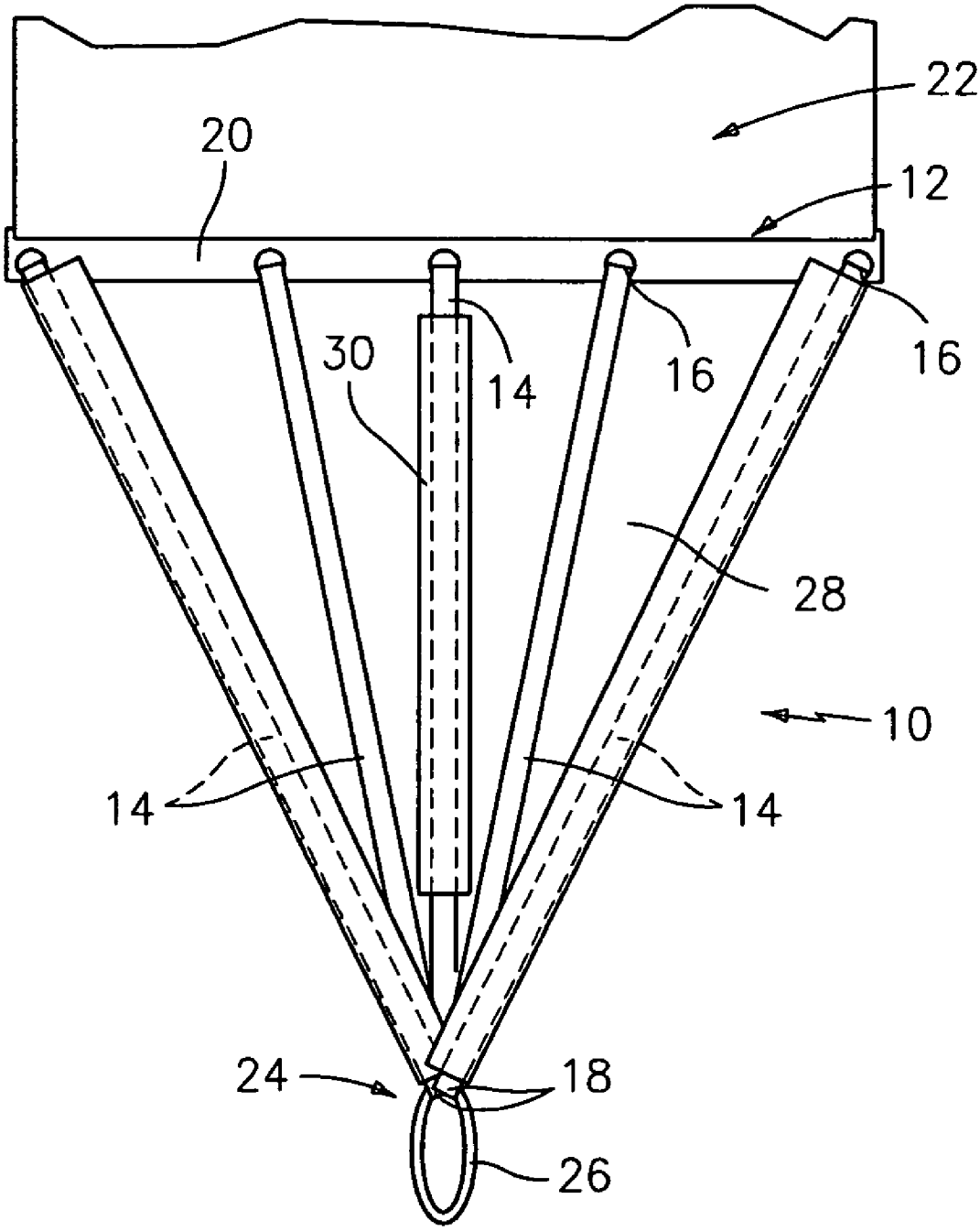
FIG. 2 shows a reverse side of the paper machine fabric leader of FIG. 1.

The invention relates to a leader for installing a fabric on a paper machine. FIG. 1-2 show a leader 10 according to the invention. Leader 10 is attached to an end 12 of fabric 22 for a paper machine. Leader 10 is used to install fabric 22 onto the paper machine as is known to a person of skill in the art.

Leader 10 has a plurality of straps 14 having first ends 16 and second ends 18. As shown in FIG. 2, first ends 16 of straps 14 define and are connected to a first end 20 of leader 10. This first end 20 can be a substantially lateral structural member to which straps 14 and end 12 of fabric 22 can be attached as shown. This first end 20 is attached to the fabric 22.

Second ends 18 of straps 14 are joined together to define a connection point 24 which allows attachment of a rope or other pulling member for pulling first leader 10 and then fabric 22 onto a paper machine. A loop 26 of material can be passed through each second end 18 of straps 14 as shown in FIG. 2, and loop 26 can be used to secure to a suitable pulling member.

As shown in the drawings, straps 14 spread from connection point 24 toward first end 20 of leader 10. Preferably, straps 14 gradually spread away from each other so that at connection point 24 all second ends 18 are substantially together, and so that all first ends 16 are substantially uniformly spaced along a width of the fabric.

Straps 14 of leader 10 also define opposite facing leader faces, and a solid sheet cover 28 is advantageously attached to one such leader face. Cover 28 can be attached to straps 14 in any suitable manner, as will be discussed below, and serves to prevent straps 14 from getting caught in a paper machine during installation of fabric 22 using leader 10. As shown, cover 28 is preferably a flexible material which is sized to cover straps 14 without extending beyond them. As best seen in FIG. 2, cover 28 can initially be sized slightly larger than the width of straps 14, and the overlapping material of cover 28 can be folded over onto the other side or face of leader 10. An additional sleeve 30 of material can also be attached to cover 28 over one or more straps 14 as shown in FIG. 2.

Cover 28 can in one embodiment be made from a substantially transparent material so that straps 14 can be viewed through cover 28, for example to inspect the position and condition of straps 14. Of course, cover 28 can alternatively be made from other types of material, including that which is not substantially transparent, and this is well within the broad scope of the invention. Within that broad scope, a transparent material is desirable as set forth above.

Cover 28 can be made from any suitable flexible material, and can be plastic or cloth, permeable or impermeable, porous or nonporous, and transparent or opaque. Within this broad scope, cover 28 is preferably made of a flexible material having a thickness of between about 1 mil and about 1 inch. Within this range, one particularly suitable example is low density polyethylene (LDPE) having a thickness of about 6 mil. Of course, other types of material could be used within the broad scope of the invention.

Cover 28 can also advantageously be provided of a material which is substantially impermeable and/or nonporous to water and other liquids to which fabric 22 might be exposed during shipping and/or storage awaiting installation on a paper machine. In this way, cover 28 serves to protect fabric 22 prior to installation on a paper machine.

Straps 14 can be made of any suitable material, keeping in mind that straps 14 are the load bearing elements of leader 10 according to the invention. Suitable materials or types of straps include but are not limited to webbing, roping, straps, and the like of nearly any material in a size large enough to carry the load imposed by pulling fabric 22.

Cover 28 can suitably be attached to straps 14 to keep straps 14 aligned as desired. Cover 28 can be attached to straps 14 in any suitable manner, examples of which include stitching, gluing, taping, riveting, grommeting, welding (including but not limited to chemical welding and high frequency welding) and combinations thereof.

It should be appreciated that straps 14 are the load bearing members of the present invention. Unlike in prior art disclosures such as those mentioned above, cover 28 serves only to cover one side of straps 14 and thereby prevent these straps from getting caught in the paper machine, and also in some embodiments of the invention to protect fabric 22 and/or allow visual inspection of straps 14 through cover 28. This provides an even pulling of fabric onto the machine by straps 14 while preventing straps 14 from getting caught, and allowing them to be inspected before installation.

In use, leader 10 is attached to the end 12 of a paper machine fabric 22 by sewing, stitching, zippering, and the like and then a pulling member such as a rope is attached to the other end of the leader, for example to loop 26. The leader 10 with attached fabric is then pulled through the machine, to position the fabric on the machine, and leader 10 can then be removed and ends of fabric 22 can be joined to complete installation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. A paper machine fabric leader, comprising:

a leader having a first end, a second end, a first leader face and a second leader face, the first end being connected to a paper machine fabric; and a solid sheet cover attached to the first leader face of the leader.

2. The paper machine fabric leader of claim 1, wherein the leader comprises a plurality of straps each having first and second ends, the first ends defining the first end of the leader and being connected to the paper machine fabric.

3. The paper machine fabric leader of claim 2, wherein the second ends of the straps define a connection point for a pull rope.

4. The paper machine fabric leader of claim 1, wherein the solid sheet cover is transparent.

5. The paper machine fabric leader of claim 1, wherein the solid sheet cover is a mesh material.

6. The paper machine fabric leader of claim 1, wherein the solid sheet cover does not extend beyond the leader.

7. The paper machine fabric leader of claim 1, wherein the solid sheet cover is substantially impermeable.

8. The paper machine fabric leader of claim 1, wherein the solid sheet cover has a thickness of between about 1 mil and about 1 inch.

9. The paper machine fabric leader of claim 1, wherein the solid sheet cover has a thickness of about 6 mils.

10. The paper machine fabric leader of claim 1, wherein the solid sheet cover comprises LDPE.

11. The paper machine fabric leader of claim 1, wherein the solid sheet cover is attached to the leader by at least one attachment selected from the group consisting of stitches, glue, tape, rivets, grommets, welds and combinations thereof.

12. A method for making a paper machine fabric leader, comprising attaching a solid sheet cover to a leader at a first leader face.

13. The method of claim 12, wherein the leader comprises a plurality of straps each having first and second ends, the first ends defining a first end of the leader, and further comprising the step of connecting the first ends to a paper machine fabric.

14. The method of claim 13, wherein the second ends of the straps define a connection point, and further comprising the step of connecting a pull rope to the connection point.

15. The method of claim 12, wherein the solid sheet cover is transparent.

16. The method of claim 12, wherein the solid sheet cover is substantially impermeable.

17. The method of claim 12, wherein the solid sheet cover has a thickness of between about 1 mil and about 1 inch.

18. The method of claim 12, wherein the solid sheet cover has a thickness of about 6 mils.

19. The method of claim 12, wherein the solid sheet cover comprises LDPE.

20. The method of claim 12, wherein the attaching step comprises attaching the sheet cover to the leader by at least one method selected from the group consisting of stitching, gluing, taping, riveting, grommeting, welding and combinations thereof.

21. A method for installing a paper machine fabric on a paper machine, comprising attaching the paper machine fabric leader of claim 1 to the paper machine fabric, and pulling the paper machine fabric leader through the machine.

* * * * *